United States Patent [19]

Nishijima et al.

[11] Patent Number: 4,771,316

[45] Date of Patent: Sep. 13, 1988

[54] COPYING DEVICE UTILIZING A PARALLEL LENS ARRAY

[75] Inventors: Masaru Nishijima, Hirakata; Shiyougo Iwai, Yamatokoriyama; Keizo Fukunaga, Yamatokoriyama; Kimihide Tsukamoto, Yamatokoriyama, all of Japan

[73] Assignee: Sharp Kabushiki Kaisha, Osaka, Japan

[21] Appl. No.: 840,451

[22] Filed: Mar. 17, 1986

[30] Foreign Application Priority Data

Mar. 19, 1985 [JP] Japan ..... 60-56357

[51] Int. Cl.[4] ..... G03G 15/00; G03G 27/54

[52] U.S. Cl. ..... 355/8; 355/14 R; 355/67

[58] Field of Search ..... 355/8, 14 R, 55, 89, 355/14 E, 14 SH, 67

[56] References Cited

U.S. PATENT DOCUMENTS

| | | | |
|---|---|---|---|
| 4,129,377 | 12/1978 | Miyamoto et al. | 355/55 |
| 4,392,740 | 7/1983 | Ito et al. | 355/14 SH X |
| 4,459,010 | 7/1984 | Hinton et al. | 355/8 |
| 4,461,564 | 7/1984 | Ikenoue | 355/14 SH X |
| 4,557,581 | 12/1985 | Wooley et al. | 355/67 X |
| 4,595,275 | 6/1986 | Sonobe | 355/14 C |

FOREIGN PATENT DOCUMENTS

| | | | |
|---|---|---|---|
| 0040548 | 11/1981 | European Pat. Off. . | |
| 3119271 | 8/1982 | Fed. Rep. of Germany . | |
| 159553 | 9/1983 | Japan | 355/8 |

*Primary Examiner*—A. T. Grimley
*Assistant Examiner*—Ed Pipala
*Attorney, Agent, or Firm*—Birch, Stewart, Kolasch, & Birch

[57] ABSTRACT

An electrophotographic copying machine device provided with a pair of lens arrays installed in parallel to enable variable- or actual-size copying and a means for selectively directing the light-path, allowing each lens array to select its light-path before projecting the original image onto a recording medium such as a photoreceptive drum, in which the copying device incorporates the following: equalizing the distance between original-scanning starting points for actual- and variable-size copying to the distance between light-exposure positions on the recording medium by applying variable-size lens array; equalizing the distance between light-exposure positions on the recording medium, corresponding to the original-scanning starting point, and the image transfer starting position, by which image on the recording medium is transferred to the transference material using the variable-size lens array, to the distance for transferring the transference material from its standby position to its transference position; and means for controlling engagement of the transference material held in a standby condition in response to the original-scanning operation activated with the variable-size lens array.

24 Claims, 1 Drawing Sheet

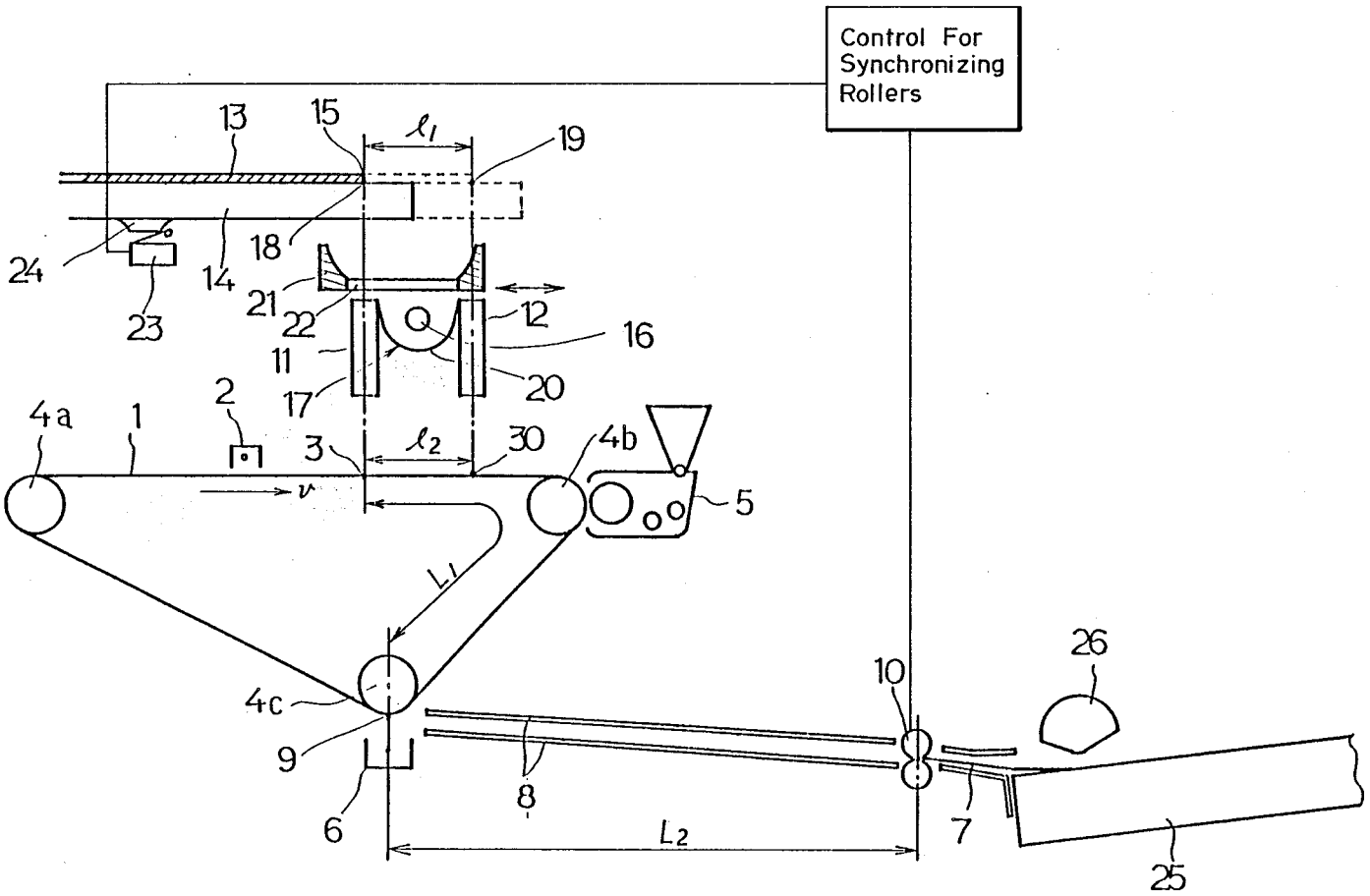
Control For Synchronizing Rollers
1
2
3
4a
4b
4c
5
6
7
8
9
10
11
12
13
14
15
16
17
18
19
20
21
22
23
24
25
26
30
$\ell_1$
$\ell_2$
$L_2$
v

COPYING DEVICE UTILIZING A PARALLEL LENS ARRAY

BACKGROUND OF THE INVENTION

The present invention relates to an electrophotographic copying device using a converging lens array as means to project the image of the original onto the recording medium.

Conventional electrophotographic copying machines form latent images by electrically charging a recording medium coated with a photo-conductive layer, then projecting a photographic image of the original onto the charged copying media. One device in the prior art uses an image-focussing lens which employs a specific focus distance f to transfer the photographic image reflected from the original through the lens and project it onto the recording medium. The expose the image of the original onto the copying media in an actual-size ratio, equal distances must be provided for the light path between lens and original and between lens and copying media, respectively. These light paths are usually provided with mirrors to ensure that the focus distance remains 2f, a technique requiring a considerably long light path. Thus the configuration of the entire unit must also be large, preventing smaller-sized copying machines.

To reduce unit size, some of the prior art devices use a converging lens array (henceforth called a lens array) as the means for projecting the image onto the recording medium. A lens array is placed between the original and the recording medium to focus the original image onto it. The length of the light path used by conventional lenses is thus reduced to allow incorporation in compact copiers. The lens array method can only be employed for actual-size ratio, however; enlargement and reduction of the original image on the copying medium is not possible using only one lens array. Installation of another lens array for variable-size copying makes it possible for a specific picture-forming device to produce copies in either actual- or variable-size. In this case, the user can choose the lens arrays according to the copy size ratio. When operating such a device, the leading edge of the copy paper and the image on the recording medium should be aligned with each other, requiring the copy paper to be fed at a different time according to the preferred scale ratio of the final copy. Because the image formation edge of the recording medium varies according to the magnification ratio, feeding of the copying paper must begin sooner when actual-size is desired than when size variation is desired. Means for controlling the copying-paper feeding operation therefore involves unavoidable complexity.

SUMMARY OF THE INVENTION

The present invention provides a novel electrophotographic copying machine, which utilizes a pair of lens arrays in parallel to allow actual- and variable-size image copying and controls the paper-feeding operations to allow the leading edge of the copy paper to correctly match the edge of the image formed on the recording medium.

Other objects and further scope of applicability of the present invention will become apparent from the detailed description given hereinafter. It should be understood, however, that the detailed description and specific examples while indicating preferred embodiments of the invention, are given by way of illustration only, since various changes and modifications within the spirit and scope of the invention will become apparent to those skilled in the art from the following detailed description.

Briefly speaking, the present invention provides a copying electrophotographic device with a pair of lens arrays in parallel to enable actual- and variable-size image copying. The device allows selective switching of the light path for each lens array to project the original image onto the recording medium before the image is formed using the selected magnification ratio. In the present invention, the distance between the original-scanning points in the actual- and variable-size modes equals the distance between the light-exposure positions on said copying medium. Further, in the device, the distance between the light-exposure position, corresponding to the original-scanning activation point, and the position for starting the transfer of the image from the said copying medium to the transference member, using the variable-size lens array, equals the distance from a standby position of the transference member to the transference position. It also controls the movement of the copying paper from this standby position in response to the original-scanning operation activated by the variable-size lens array.

BRIEF DESCRIPTION OF THE DRAWING

The present invention will be better understood from the detailed description given hereinbelow and the accompanying drawing which is given by way of illustration only, and thus is not limitative of the present invention and wherein the accompanying drawing is the sectional view denoting main constituents of the present invention.

DETAILED DESCRIPTION OF THE PREFERRED EMBODIMENTS

The accompanying drawing is the sectional view denoting the main configuration of the copying device related to the present invention. Reference numeral 1 indicates a belt-shaped photoreceptive element which is a recording medium incorporating photoconductive layers. Reference numeral 2 indicates the main corona discharger that electrically charges the entire surface of the belt-shaped photoreceptive element 1 in a specific polarity. The reference numerals 3 and 30 respectively indicate exposure positions at which the original image is projected onto the photoreceptive element 1. The photoreceptive element 1 is held in place by 3 rolls, **4*a*, 4*b* and 4*c*. Through the revolution of roll 4*a*, the belt-shaped photoreceptive element 1 moves in the arrowed direction at a constant speed v. Simultaneous with the projection of an image at either exposure position 3 or 30, a corresponding electrostatic latent image is formed on the surface of the photoreceptive element 1. The image is later developed by a developer unit 5. A corona discharger 6, located opposite roll 4*c* and photoreceptive element 1 transfers the developed image (toner image) on the photoreceptive element 1 to a copying paper 7. The copying paper 7 is delivered to a transference position 9 via a guide member 8. The copying paper 7 is preliminarily set to a synchronizing roller 10 in order that the leading edge of the image formed on the photoreceptive element 1 and the leading edge of the copying paper 7 become properly aligned at the transference position 9 synchronous with the travel of the photoreceptive element 1**. The synchronizing roller 10 moves simultaneously with the photoreceptive element 1 in order to deliver the copying paper 7 at the proper time to the transference position 9. The original image is exposed at either exposure position 3 or 30 by means of lens array 11 or 12. An original 13 is placed on a transparent glass table 14, where the leading edge of the original 13 is correctly aligned with an index 15 on the original table 14. The table 14 reciprocates synchronously with movement of the photoreceptive element 1. The lens arrays 11 and 12 are installed between the photoreceptive element and the original in such a way that the light reflected from the original 13 in actual- and variable-size modes are in parallel. The lens array 11 is used for variable-size copying, and the lens array 12 for actual-size copying. The original 13 on the table 14 is illuminated by an illumination device 17 containing lamp 16. The illumination device 17 is installed between lens arrays 11 and 12 and provided with a reflection board 20 to intensively illuminate exposure activating points 18 or 19 of lens arrays 11 or 12. The exposure activating point 18 is the optically-scanned position of the original 13 on the original table 14 in relation to the light path of lens array 11, whereas an exposure activating point 19 is the optically-scanned position of the original 13 on the original table 14 in relation to the light path of lens array 12. A light-shielding plate 21, which redirects these light paths, is installed between the illumination device 17 and the original table 14. Light shielding plate 21 moves in parallel to the table 14. The light-shielding plate 21 forms a slit 22 through which light from the illumination device 17 can pass. When the light-shielding plate 21 is at the position shown in the FIGURE, it blocks light from lens array 12 (for actual-size copying) and facilitates light from the lens array 11 (for variable-size copying). The curved surface of the light-shielding plate 21 aids reflection, which improves the efficiency of the illumination device 17.

The original image at the exposure-activation point 18, present in the light path of the variable-size copying lens array 11, is formed at the exposure position 3 of the photoreceptive element 1. The original image at the exposure-activation point 19, present in the light path of the actual-size lens array 12, is formed at the exposure position 30 of the photoreceptive element 1. The distance L2 needed for conveying the copying paper 7 from the synchronizing roller 10 to the transference position 9 is set exactly identical to the length L1 of the photoreceptive element 1, the distance between the exposure position 3 and the transference position 9 when using the variable-size copying lens array 11. In other words, the relationship L1=L2 is established so that the leading edge of the image formed on the photoreceptive element 1 arrives at the transference position 9 simultaneous with the arrival of the leading edge of the copying paper 7. The synchronizing roller 10 is activated as soon as the leading edge of the original on the table 14 arrives at the exposure-activation point 18 present in the light path of the variable-size copying lens array 11. A microswitch 23 is attached to the copying machine and activated by a projection 24 on the underside of table 14. The projection 24 is mounted on the side of the table 14, which is itself independent of the image-exposure operation. The microswitch 23 is located opposite the projection 24. Both the microswitch 23 and the projection 24 are held in a specific position to activate of the microswitch 23 as soon as the leading edge of the original 13 (corresponding to the index edge 15 shown in the drawing) on the original table 14 reaches the exposure activating point 18. When the microswitch 23 is activated by the projection 24, an activation signal is delivered to the control circuit (not shown). Upon receipt of this signal, the control circuit drives the synchronizing roller 10 for the specific period of time necessary to transport the copying paper 7 to the transference position 9. As described earlier, the copy paper 7 is preliminarily set to the synchronizing roller 10. Normally, an amount of copy paper 7 is stored in a paper-feeding cassette 25, which can be loaded into and unloaded from the copying machine. Each copy paper 7 is fed by a sector paper-feeding roller 26 installed above the paper cassette. Interposed between a pair of synchronizing rollers 10, the copying paper 7 is held stationary briefly. These synchronizing rollers 10 transport the copying paper 7 at a speed identical to the moving speed v of the photoreceptive element 1. To better understand the constitution of the copying device reflecting the present invention, functional operations of the copying machine incorporating this device are described below. First, the original table 14 is preset to the exposure activating position before exposure begins. When the user desires copying of a varied scale, the light-shielding plate 21 is set to the position shown in the accompanying drawing. As soon as the tip position of the original 13 arrives at the exposure-activating point 18 by the movement of the original table 14, the picture image of the original 13 is sequentially projected onto the photoreceptive element 1. Since the magnification ratio is applicable in this case, if the magnification ratio is "a" versus the travelling speed "v" of the photoreceptive element 1, the original table 14 is driven forward at v/a speed. As soon as the index edge 15 of the original table 14, that is, the leading edge of the original 13, arrives at the exposure-activating point 18 when variable-size copying is underway, the leading edge of the original is exposed to the photoreceptive element 1 at the exposure position 3. The projection 24 then activates the micrswitch 23, thus rotating the synchronizing rollers 10. The copying paper 7 held by these synchronizing rollers 10 is then transported at a speed identical to the travelling speed of the photoreceptive element 1. The time duration between the arrival of the leading edge of the original 13 at the exposure-activating point 18 and the leading edge of the copying paper 7 arrives at the transference position 9 is denoted by L2/v. The time it takes part of the photoreceptive element 1 containing the exposed image of the tip position of the original 13 to arrive at the transference position 9 from the exposure position 3 is denoted by L1/v. Both the microswitch 23 and the projection 24 are located so that the initial movement of the photoreceptive element 1 and the initial movement of the copying paper 7 via the synchronizing rollers 10 match exactly. Furthermore, the copying device establishes length L1 of the photoreceptive element 1 from the exposure position 3 to the transference position 9 exactly identical to the distance L2 needed for transporting the copying paper 7 from the synchronizing rollers 10 to the transference position 9. As a result, the duration from the start of exposure of the image on the leading edge of the original 13 to the arrival of the image-laden part of the photoreceptive element 1 at the transference position 9 and the duration from the start of the exposure to the arrival of the copying paper 7 at the transference position 9 correctly matches. The leading edge of the copying paper 7 is thus correctly aligned with the leading edge of the image formed on the photoreceptive element 1 at the transference position 9.

Control of copying paper 7 transportation under the actual-size mode is described below. When the user chooses actual-size copying, the light-shielding plate 21 is shifted, exposing the actual-size copying lens array 12 so that the latent image can be exposed. Since actual-size copying is performed, the original table 14 is driven forward at a specific speed identical to the travelling speed v of the photoreceptive element 1. When the copying switch is pressed, the original table 14 is first set to a specific position for activating exposure of the original 13. Copying is activated and the controller outputs a command signal for activating the forward movement of the original table 14. The original table 14 starts its movement. When the tip position of the original 13 arrives at the exposure activating point 18, the projection 24 then activates the microswitch 23. The rotation of the synchronizing rollers 10 thus start delivering the copying paper 7 held between these rollers 10. During this period, even if the leading edge of the original 13 is already at the exposure activating point 18 in conjunction with the variable-size lens array 11, the leading edge of the original cannot be exposed to the photoreceptive element 1 because the lens array 11 is shielded from light. When the leading edge of the original 13 arrives at the exposure-activating point 19 in the light path of the actual-size lens array 12 after passing through the exposure activating point 18, latent image of the original is sequentially exposed onto the photoreceptive element 1 in the exposure position 30 from the leading edge of the original 13. If the light paths of lens arrays 11 and 12 and also the original table 14 and the exposure surface of the photoreceptive element 1 are respectively located in parallel to each other, the distance l1 between the exposure activating points 18 and 19 and the distance l2 between the exposure positions 3 and 30 on the photoreceptive element 1 are identical (l1=l2). Accordingly, the time it takes the the original-setting table 14 at the exposure activating point 18 to arrive at the exposure activating point 19 and the time it takes the table 14 to arrive from the place corresponding to the exposure position 3 on the photoreceptive element 1 to the position 30 exactly match. In other words, since the original table 14 and the photoreceptive element 1 move at an identical speed and the distances l1 and l2 are also identical, as soon as part of the photoreceptive element 1 corresponding to the exposure position 3 arrives at the exposure position 30, the leading edge of the original 13 reaches the exposure activating point 19, and exposure is executed. Note that the duration between the start of the formation of the actual-size image and the arrival of the tip edge of the formed image at the transference position 9 is denoted as (L1−l2)/v. The duration between the start of the transport of the copying paper 7 and its arrival at the transference position 9 is denoted to be L2/v. Note that the transport of the copying paper 7 is activated earlier than the start of forming the latent image when the actual-size copying is underway. The distance needed for transporting the copying paper 7 to the position of activating the light exposure under the actual-size copying mode corresponds to the result of multiplying the time l1/v needed from the arrival of the original table 14 at the actual-size image exposure activating point from the variable-size image exposure activating point 18 by the copying-paper transport speed v, yielding the result l1. As soon as the copying paper 7 is transported by the distance l1 from the synchronizing rollers 10, light is exposed to the actual-size image. The duration from the start of light exposure to the actual-size image until the arrival of the tip position of the copying paper 7 to reach the transference position is denoted as (L2−l1)/v. Consequently, in light of the identical relationship between L1 and L2 (L1=L2) and l1 and l2 (l1=l2), the time needed for the leading edge of the formed image on the photoreceptive element 1 to arrive at the transference position 9 during the actual-size mode (denoted in terms of (L1−l2)/v) and the time needed for the leading edge of the copying paper 7 to arrive at the transference position 9 from the start of the light exposure to the image during the actual-size mode (denoted as (L2−l1)/v) correctly match. Even when applying the actual-size copying scale, the leading edge of the copying paper correctly matches the leading edge of the image formed on the photoreceptive element 1 at the transference position.

As an example, the above preferred embodiment sets in parallel the light paths of lens arrays l1 and l2, the original-setting table 14 and the light-exposed surface of the photoreceptive element 1 to make the distances 1 and l2 equal. To realize this embodiment, light paths of lens arrays 11 and 12 may not always be parallel with each other, but merely provide equal distances between the light-exposure activating points of both lens arrays 11 and 12 and the exposure positions of the photoreceptive element 1. In summary, the objects of the present invention can be realized by making the length from the light exposure starting point in the variable-size copying mode to the exposure starting point in the actual-size copying mode equal to the length between the light exposure positions on the recording medium in both modes. The length of the recording medium from the light-exposure starting position to the transference starting position equals the distance needed for transporting the copying paper from its standby position to the transference starting position. As a result, the copying machine incorporating the configuration embodied by the present invention allows, without providing a delayed circuit or a timer, both the leading edge of the copying paper and the leading edge of the image formed on the recording medium to be perfectly aligned with each other by constantly applying variable-size paper-transport timing. Compulsory control of the paper-transport timing using either delay circuit or timer means is not necessary.

Switching of light paths between lens arrays 11 and 12 under the varied- or actual-size modes by the light-shielding plate 21 may be executed manually, or by motor along with the setting of the magnification ratio.

A pair of lens arrays are provided in parallel in accordance with respective sizes desired to project the original image on the recording medium, while said copying device is also provided with means for selectively switching light paths of these lens arrays.

The copying device embodied by the present invention equals the distances between at least two light-exposure starting positions of the recording medium in the variable- and actual-size modes to the distance from the light-exposure starting point in the variable-size mode to the light-exposure starting point in the actual-size mode. The copying device also equalizes the distance needed for transporting the copying paper from the standby position to the transference starting position with the distance from the light-exposure starting starting position in the variable-size mode to the transference starting position in the variable-size mode. Consequently, independent of the mode applied, merely by activating the transport of the copying paper at the light-exposure activating time under the variable-size mode, the leading edge of the copying paper correctly matches the leading edge of the image formed on the recording medium in both modes.

Furthermore, in order to have these tip positions perfectly match, no particular means such as delay circuit is needed, but could be implemented using an extremely simplified constitution.

While only certain embodiments of the present invention have been described, it will be apparent to those skilled in the art that various changes and modifications may be made therein without departing from the spirit and scope of the present invention as claimed.

What is claimed is:

1. An electrophotographic copying system for producing a copy of an original, said copying system comprising:

a movable endless photoreceptive element;

movable original support means for movably supporting the original at a distance with respect to said photoreceptive element during a scanning operation of the original;

a pair of lens arrays disposed between said photoreceptive element and said original support means and located at different positions in the direction of travel of said movable original support means, said pair of lens arrays comprises one actual and one varied scale lens for producing variable-size copying;

means for synchronizing the movement of said movable endless photoreceptive element relative to said movable original support means for proper scale exposure of the original onto said movable photoreceptive element;

an illumination device for illuminating the original, said illumination device being positioned between said lens arrays;

shielding means for selectively blocking the projection of light reflected from the original and passed through one of the lens arrays during a copying mode utilizing the other lens array;

means for developing an image of the original with developer and for transferring the developed image of the original onto a recording medium;

a recording medium delivery means for delivering recording medium onto said movable endless photoreceptive element at a transference position; and switch means associated with said original support means for activating said recording medium delivery means at a same activating point in the path of movement of said original support means regardless of which lens array is in use during a copying operation.

2. The copying system according to claim 1, wherein a distance between an exposure position on said movable endless photoreceptive element corresponding to said activating point and said transference position is equal to a pathway length of movement of the recording medium along said recording medium delivery means, and further wherein said movable endless photoreceptive element is moved at the same speed as the speed of movement of the recording medium along said recording medium delivery means for ensuring proper registering of the developed image of the original on the movable endless photoreceptive element with the recording medium at said transference position.

3. The copying system according to claim 2, wherein said recording medium delivery means comprises a guide member of a predetermined length having a synchronizing feed roller controlled by said switch means at one end and extending towards said movable endless photoreceptive element with an opposite end positioned adjacent said transference position.

4. The copying system according to claim 1, wherein said switch means is a microswitch fixed from movement and positioned adjacent said original support means, said microswitch being activated by a protrusion extending from said original support means engaging with said microswitch during movement of said original support means.

5. The copying system according to claim 1, wherein said movable endless photoreceptive element is an endless belt having a photoconductive surface, said belt being supported by a plurality of rolls.

6. The copying system according to claim 1, including a reflector positioned between said lens arrays and adjacent to said illumination device for further enhancing the illumination of the original.

7. The copying system according to claim 1, wherein said shielding means comprises a light-shielding plate having a slit therethrough.

8. The copying system according to claim 6, wherein said shielding means comprises a light-shielding plate having a slit therethrough.

9. The copying system according to claim 8, wherein said light-shielding plate includes curved surfaces positioned on either side of said slit for aiding the reflection of light from said illumination device.

10. The copying system according to claim 9, wherein said reflector is concave shaped to reflect light from said illumination device towards the original and sais curved surfaces of said light-shielding plate are concave shaped for providing an extension of the reflecting surface of said reflector.

11. The copying system according to claim 5, wherein said original support means is a substanially planar transparent support table, sais support table is positioned parallel to a substantially planar section of said endless belt supported between two of said rolls on which the reflected image of the original is exposed through one of said lens arrays.

12. The copying system according to claim 11, wherein said pair of lens arrays are parallel with respect to each other.

13. The copying system according to claim 11, wherein said original support means supports the original at a fixed distance with respect to said photoreceptive element.

14. An electrographic copying system for producing a copy of a original, said copying device system comprising:

a movable photoreceptive element;

movable substanially planar original support means for supporting the original at a distance with respect to said photoreceptive element;

a pair of parallel lens arrays fixed from movement and disposed between said photoreceptive element and said original support means, said pair of lens arrays comprises one actual and one varied scale lens for providing variable-size copying;

an illumination device for illuminating the original, said illumination device being disposed between said lens arrays;

shielding means for selectively blocking the projection of light reflected from the original through one of the lens arrays during copying mode utilizing the other lens array;

means for synchronizing the movement of said movable photoreceptive element relative to said movable original support means for proper scale exposure of the original onto said movable photoreceptive element;

means for developing an image of the original with developer and for transferring the developed image on a recording medium;

a guide member of a predetermined length in combination with a synchronizing feed roller positioned at one end of said guide member for feeding the recording medium onto said movable photoreceptive element at a transference position located at on opposite end of said guide member; and switch means cooperating with said original support means for activating said synchronizing roller when a leading edge of the original being transported by said original support means reaches a first activating point in the path of movement of the original regardless of which one lens array is being utilized for exposing said photoreceptive element with the reflected original image, wherein the distance between said first activating point and a corresponding first exposure position on said photoreceptive element through one of the lens arrays is substantially equal to the distance between a second activating point in the path of movement of the original and a corresponding second exposure position on said photoreceptive element through the other lens array and wherein the distance between said first exposure position and said transference position on said movable photoreceptive element is substantially equal to said predetermined length of said guide member and said movable photoreceptive element is moved at the same speed of movement as the recording medium along said guide member for ensuring the proper registering of the recording medium with an exposed image of the original on said movable photoreceptive element regardless of the scale mode of the operation of the copying system.

15. The copying system according to claim 14, wherein said movable photoreceptive element is an endless belt having a photoconductive surface supported for movement by a plurality of rolls with a substantially planar portion of said endless belt being supported between two of said rolls and parallel to said substantially planar original support means.

16. The copying system according to claim 15, wherein said original support means is a transparent support table.

17. The copying system according to claim 14, wherein said switch means is a microswitch fixed from movement and positioned adjacent said original support means, said microswitch being activated by a protrusion extending from said original support means engaging with said microswitch during movement of said original support means.

18. The copying system according to claim 14, including a reflector positioned between said lens arrays and adjacent to said illumination device for further enhancing the illumination of the original.

19. The copying system according to claim 14, wherein said shielding means comprises a light-shielding plate having a slit therethrough.

20. The copying system according to claim 18, wherein said shielding means comprises a light-shielding plate having a slit therethrough.

21. The copying system according to claim 20, wherein said light-shielding plate includes curved surfaces positioned on either side of said slit for aiding the reflection of light from said illumination device.

22. The copying system according to claim 21, wherein said reflector is concave shaped to reflect light from said illumination device towards the original and said curved surfaces of said light-shielding plate are concave shaped for providing an extension of the reflecting surface of said reflector.

23. The copying system according to claim 14, wherein said pair of lens arrays are parallel with respect to each other.

24. The copying system according to claim 14, wherein said original support means supports the original at a fixed distance with respect to said photoreceptive element.

* * * * *